United States Patent [19]

Anzenberger

[11] 4,263,062

[45] Apr. 21, 1981

[54] RUST-PREVENTIVE COMPOSITIONS

[75] Inventor: Joseph F. Anzenberger, New City, N.Y.

[73] Assignee: Stauffer Chemical Company, Westport, Conn.

[21] Appl. No.: 63,317

[22] Filed: Aug. 2, 1979

[51] Int. Cl.[3] ..... C23F 7/10

[52] U.S. Cl. ..... 148/6.15 R; 106/14.43

[58] Field of Search ..... 148/6.15 R; 252/32.5, 252/33, 39, 56 R, 49.8; 106/14.43

[56] References Cited

U.S. PATENT DOCUMENTS

| | | | |
|---|---|---|---|
| 2,080,299 | 5/1937 | Benning et al. | 252/49.8 |
| 3,396,114 | 8/1968 | Vienna et al. | 252/33 |
| 3,483,122 | 12/1969 | MacPhail et al. | 252/49.8 |
| 3,718,596 | 2/1970 | Richard | 252/49.8 |
| 4,142,903 | 3/1979 | Antonelli | 106/14.24 |
| 4,181,619 | 1/1980 | Schmitt et al. | 252/32.5 |

OTHER PUBLICATIONS

Shell Chemical Co., Technical Bulletin SC: 8-76-Tergol 8BH.

Shell Chemical Co., Technical Bulletin SC: 9-78-Tergol 5240.

*Primary Examiner*—Ralph S. Kendall

*Attorney, Agent, or Firm*—Roger S. Benjamin

[57] ABSTRACT

A rust-preventive composition is provided which is useful for protecting metal surfaces. The composition contains as essential ingredients (1) an aryl phosphate ester (2) an oil-soluble calcium sulfonate, and (3) a liquid polyolester.

6 Claims, No Drawings

RUST-PREVENTIVE COMPOSITIONS

BACKGROUND OF THE INVENTION

Phosphate esters are finding increasing use as fire resistant lubricating and hydraulic fluids. These ester lubricants have the desirable properties of low flammability, high lubricity and long service life.

New machinery or machinery in storage or transport which is designed for use with phosphate esters is frequently rust-proofed with conventional petroleum based compositions or other formulations which are not compatible with phosphate esters. This situation often necessitates an extensive cleaning of rust preventive treated machinery before operation with phosphate ester based fluids may be begun.

SUMMARY OF THE INVENTION

It is an object of this invention to provide improved corrosion inhibiting compositions which are compatible with phosphate ester lubricants and are effective in controlling rust.

It is a further object of this invention to provide a method of rust proofing machinery by the application of phosphate ester containing rust-preventive compositions. The above and other objects of the present invention are accomplished by the use of rust inhibiting compositions which contain three essential ingredients, specifically, (1) an aryl phosphate ester, (2) an oil-soluble calcium sulfonate and, (3) liquid polyolester.

This invention is related to the protection of surfaces composed both of ferrous and non-ferrous metals which are subject to corrosion by atmospheric conditions such as encountered during periods of inactivity such as storage, transport, maintenance or repair.

DETAILED DESCRIPTION OF THE INVENTION

The first essential component of the rust-preventive composition of this invention is a liquid aryl phosphate ester.

Suitable aryl phosphate esters are represented by the formula:

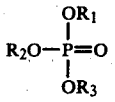

wherein $R_1$, $R_2$, and $R_3$ are the same or different and are selected from aryl, alkaryl, alkyl, aralkyl or cycloalkyl radicals having one to about thirty carbon atoms; with the proviso that at least one of $R_1$, $R_2$, $R_3$, is aryl or alkaryl. Most preferred are triaryl phosphates wherein $R_1$, $R_2$, or $R_3$ are all aryl or alkaryl radicals. Examples of suitable triaryl phosphates are triphenyl phosphate, tricresyl phosphate, trixylyl phosphate, cresyl diphenyl phosphate, isopropylphenyl diphenyl phosphate, di-isopropylphenyl/diphenyl phosphate, tertiary-butylphenyl/diphenyl phosphate or ditertiary-butylphenyl/-diphenyl phosphate. A mixture of phosphate esters may be used if desired. The aryl phosphate ester component constitutes about 50 to about 95 weight percent of the rust inhibiting composition. Preferably, the aryl phosphate ester constitutes from 65 to 90 weight percent of the rust preventive composition.

The second essential ingredient in the rust-preventive composition is an oil-soluble calcium sulfonate.

Oil-soluble calcium sulfonates are detergent additives having a molecular weight of from about 350 to about 550. These sulfonates are formed by reacting petroleum sulfonic acid with a 10 to 100 percent excess of calcium carbonate or calcium hydroxide neutralizing agent. The oil-soluble calcium sulfonate ingredient should constitute from about 0.1 to about 5.0 weight percent of the rust-preventive composition.

The third essential ingredient of the rust-preventive composition is a liquid polyolester having a viscosity of 4.30 cSt to 4.70 cSt at 100° C. The polyolester is the reaction product of a polyhydric alcohol and a monocarboxylic acid. Examples of suitable polyhydric alcohols are ethylene glycol, propylene glycol, neopentylene glycol, trimethylolpropane, pentaerythritol, or dipentaerythritol. Mixtures of polyols may be used if desired. Examples of suitable monocarboxylic acids are straight or branched chain acids of at least eight carbon atoms such as octanoic acid, decanoic acid, stearic acid, and 2-ethyl hexanoic acid. Mixtures of acids may be used if desired. A preferred polyolester is the reaction product of pentaerythritol with butyric and heptanoic acids.

The liquid polyolester ingredient constitutes from about 5 to about 50 weight percent of the rust-preventive composition. Preferably, the proportion of liquid polyolester is from about 20 to about 30 weight percent of the composition.

The three essential ingredients previously descried are mixed to form a single phase. The essential ingredients should comprise in combination at least 80 weight percent of the rust-preventive composition. The balance of the composition may, if desired, include minor amounts of optional ingredients such as dyes, perfumes or diluents. Other corrosion inhibiting agents may be mixed with the rust-preventive compositions if desired.

Any optional ingredients should be completely miscible with the mixture of essential ingredients of the rust-preventive composition.

Metal surfaces (especially, ferrous metal surfaces) are protected from corrosion by applying a coating of the rust-preventive composition of this invention. The composition may be applied by any conventional means such as spraying, dipping, brushing, flushing, etc. Since the rust-preventive composition has the ability to adhere to metal surfaces, it is only necessary to contact the metal with the composition to deposit a rust-preventive effective coating.

The following examples illustrate the formulation and manner of use of the composition of this invention.

EXAMPLE

This example illustrates the preparation and use of the rust-preventive composition. In addition, this example compares the composition of this invention to control compositions and compositions containing known rust preventive additives.

Test Procedure

A steel paint panel (approx. 7.62 cm.×12.7 cm.) was completely immersed in a rust-preventive formulation. The panel was allowed to drip dry for thirty minutes. The panel was then laid flat in a container slightly larger than the panel and eighty milliliters of distilled water was poured into the container to completely cover the panel. The container was allowed to stand at room temperature until all of the water evaporated. The test panel was then examined and evaluated for rust formation.

Rust-Preventive Compositions (all percentages by weight)

Sample A—Trixylyl phosphate (FYRQUEL 220, product of Stauffer Chemical Company) 79 weight percent; oil-soluble calcium sulfonate detergent additive (TERGOL 8BH, product of Shell Chemical Co.) 1% liquid polyolester, a reaction product of pentaerythritol with $C_7$ and $C_4$ alkanoic acids (BASE STOCK 874, product of Stauffer Chemical Company) 20%.

Sample B—Trixylyl phosphate (ingredient used in Sample A) 78%; oil-soluble calcium sulfonate detergent additive (ingredient used in Sample A) 2%; liquid polyolester (ingredient used in Sample A) 20%.

Sample C—Trixylyl phosphate (ingredient used in Sample A) 100%.

Sample D—Trixylyl phosphate (ingredient used in Sample A) 99%; calcium sulfonate detergent additive (TERGOL 180H, product of Shell Chemical Company) 1%.

Sample E—Trixylyl phosphate (ingredient used in Sample A) 99%; calcium sulfonate detergent additive (ingredient used in Sample A) 1%.

Sample F—Trixylyl phosphate (ingredient used in Sample A) 99%; dilauryl acid phosphate rust inhibitor (ORTHOLEUM 162, product of E. I. Dupont Company) 1%.

Sample G—Trixylyl phosphate (ingredient used in Sample A) 99%; fatty imidazoline tertiary amine inhibitor (UNAMINE C, product of Lonza, Inc.) 1%.

Each of the above sample compositions was employed in the described test procedure. Experimental results are displayed in the Table below:

TABLE

| Sample | Test Results |
|---|---|
| A* | No Rust |
| B* | No Rust |
| C | Heavy Rust |
| D | Medium Rust |
| E | Light Rust |
| F | Medium Rust |
| G | Heavy Rust |

*These samples conform to the rust-preventive compositions of this invention.

The combination of the three essential ingredients of the rust-preventive composition of this invention show superior corrosion resisting properties in comparison to selected individual ingredients or other known anti-corrosion agents.

What is claimed:

1. A rust preventive composition consisting essentially of:

(A) from 65 to 90 weight percent of an aryl phosphate ingredient represented by the formula:

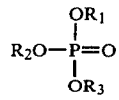

wherein $R_1$, $R_2$, and $R_3$ are the same or different and are selected from aryl, alkaryl, alkyl, aralkyl or cycloalkyl radicals having from one to about thirty carbon atoms; with the proviso that at least one of $R_1$, $R_2$, or $R_3$ is aryl or alkaryl;

(B) from about 0.1 to about 5.0 weight percent of an oil soluble calcium petroleum sulfonate ingredient; and (C) from about 20 to about 30 weight percent of a liquid polyolester ingredient, said polyolester ingredient being the reaction product of a polyhydric alcohol and a hydrocarbonaceous monocarboxylic acid.

2. The composition of claim 1 wherein the phosphate ingredient of part (A) is a triaryl phosphate ester.

3. The composition of claim 2 wherein the triaryl phosphate ester is selected from the group consisting of triphenyl phosphate, tricresyl phosphate, trixylyl phosphate, isopropylphenyl/diphenyl phosphate, tertiary-butylphenyl/diphenyl phosphate.

4. A method of preventing corrosion of metal surfaces by coating said surfaces with a composition consisting essentially of:

(A) from 65 to 90 weight percent of an aryl phosphate ingredient represented by the formula:

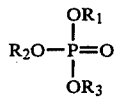

wherein $R_1$, $R_2$, and $R_3$ are the same or different and are selected from aryl, alkaryl, alkyl, aralkyl or cycloalkyl radicals having from one to about thirty carbon atoms; with the proviso that at least one of $R_1$, $R_2$, or $R_3$ is aryl or alkaryl;

(B) from about 0.1 to about 5.0 weight percent of an oil soluble calcium petroleum sulfonate ingredient; and (C) from about 20 to about 30 weight percent of a liquid polyolester ingredient, said polyolester ingredient being the reaction product of a polyhydric alcohol and a hydrocarbonaceous monocarboxylic acid.

5. The method of claim 4 wherein the phosphate ingredient of part (A) is a triaryl phosphate ester.

6. The method of claim 4 wherein the metal surface contains a ferrous metal.

* * * * *